US009619952B1

(12) United States Patent
Zhao et al.

(10) Patent No.: US 9,619,952 B1
(45) Date of Patent: Apr. 11, 2017

(54) SYSTEMS AND METHODS OF PREVENTING ACCESS TO USERS OF AN ACCESS CONTROL SYSTEM

(71) Applicant: Honeywell International Inc., Morristown, NJ (US)

(72) Inventors: Liugang Zhao, Shanghai (CN); Hongshan Zhang, Shanghai (CN); Binbin Zhu, Shanghai (CN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 15/044,611

(22) Filed: Feb. 16, 2016

(51) Int. Cl.
*G07C 9/00* (2006.01)

(52) U.S. Cl.
CPC ..... *G07C 9/00174* (2013.01)

(58) Field of Classification Search
CPC ..... G07C 9/00174; G07C 9/00904; G07C 9/00912; G07C 9/00103
See application file for complete search history.

(56) References Cited

U.S. PATENT DOCUMENTS

2012/0133482 A1* 5/2012 Bhandari ..... G07C 9/00103 340/5.2

* cited by examiner

*Primary Examiner* — Kristy A Haupt
(74) *Attorney, Agent, or Firm* — Husch Blackwell LLP

(57) ABSTRACT

Systems and methods are provided that include preventing access to users of an access control system, for example, by facilitating an administrator temporarily forbidding access by all users to one or more areas secured by one or more doors associated with one or more card readers. Some methods can include reading a first management card at a first card reader, identifying a first group of which the first card reader is a part, identifying a plurality of card readers in the first group, and updating a database device to indicate that access via the first card reader or any card reader in the plurality of card readers is forbidden.

18 Claims, 2 Drawing Sheets

SYSTEMS AND METHODS OF PREVENTING ACCESS TO USERS OF AN ACCESS CONTROL SYSTEM

FIELD

The present invention relates generally to access control systems. More particularly, the present invention relates to systems and methods of preventing access to users of an access control system.

BACKGROUND

In known access control systems, a cardholder user can swipe or otherwise present an access card to a card reader. Responsive thereto, an associated access controller can access an associated database to determine the access privileges of the user associated with the presented access card. If the access controller determines that the user has been assigned the privilege of accessing a region secured by a door associated with the card reader, then the access controller can transmit a signal to open the door. However, if the access controller determines that the user has not been assigned the privilege of accessing the region secured by the door, then the access controller will not transmit a signal to open the door.

Known access control systems support controlling access to secured regions based on a time of day. For example, in addition to determining whether a user associated with a presented access card has access privileges to a secured region, known access controllers can also determine whether the user has access privileges during the time of day at which the access card is presented. However, special circumstances may arise, for example, a high security situation, that may result in an administrator wanting to temporarily forbid access by all users to one or more areas secured by one or more doors associated with one or more card readers.

In view of the above, there is a continuing, ongoing need for improved systems and methods.

DETAILED DESCRIPTION

Figure 1:
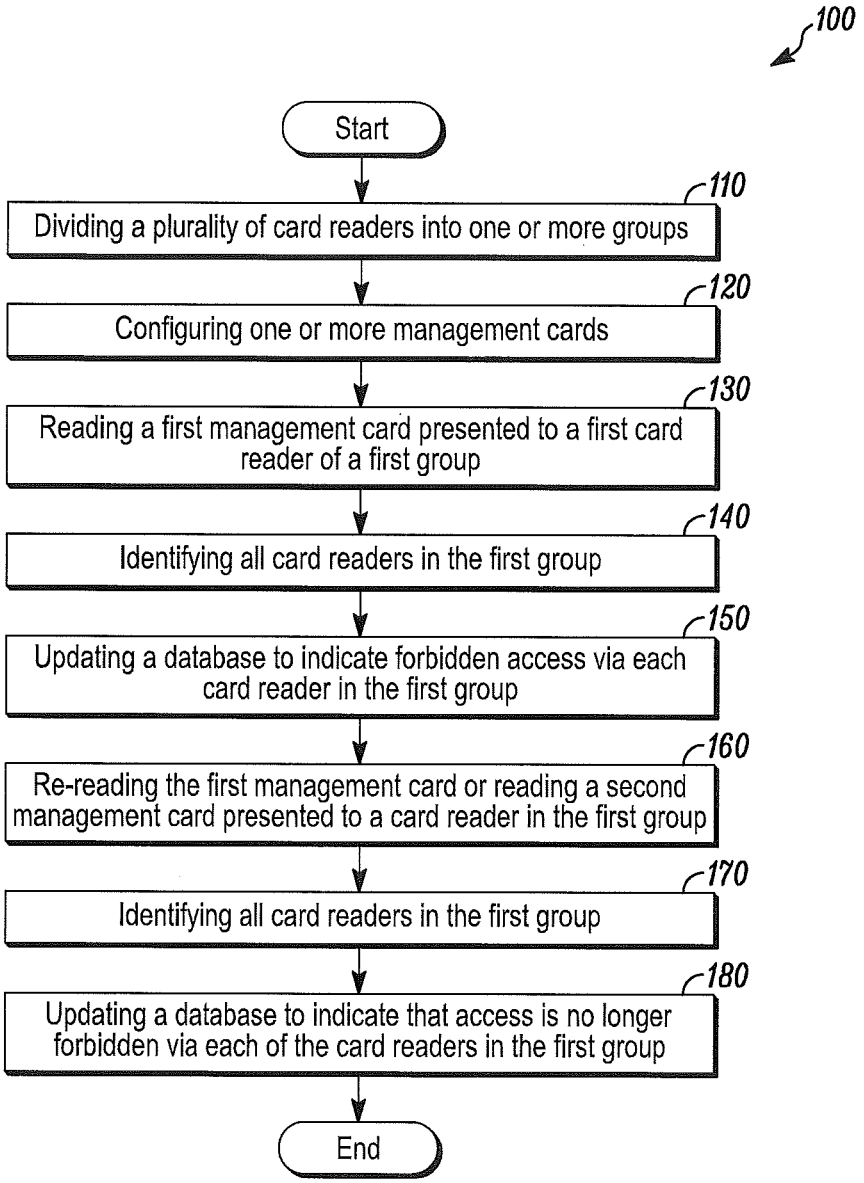
FIG. 1 is a flow diagram of a method in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include systems and methods of preventing access to users of an access control system. For example, the systems and methods disclosed herein can facilitate an administrator temporarily forbidding access by all users to one or more areas secured by one or more doors associated with one or more card readers.

In accordance with disclosed embodiments, an administrator can define one or more groups of card readers in an access control system that are associated with one or more doors in an associated secured region. For example, the one or more groups can be defined in an associated access controller or supporting host system or in a database thereof or associated therewith. The administrator can also configure a management card, for example, a forbid card or a cancel forbid card, for locking or unlocking access to regions secured by doors associated with respective card readers. For example, the associated access controller or supporting host system can associate the management card with an instruction to forbid access or to cancel any previously forbidden access.

An administrator or other person in possession of the management card can swipe or otherwise present the management card to one card reader in a group. Responsive thereto, an associated access controller can update an associated database to indicate that access via a door associated with the one card reader is forbidden. Responsive to the administrator swiping or otherwise presenting the management card to the one card reader in the group, the associated access controller can also update the associated database to indicate that access via doors associated with all other card readers in the group is forbidden. Then, when any user presents any normal access card to either the one card reader or any of the other card readers in the group, access will be denied.

In some embodiments, after the access controller updates the database to indicate the forbidden access, a user interface device, such as an LED, of each of the card readers in the group can be activated to indicate the forbidden access. Additionally or alternatively, in some embodiments, after a user presents a normal access card to any card reader in the group, the user interface device of the card reader to which the normal access card was presented can be activated to indicate the forbidden access.

The administrator or other person in possession of the management card, for example, a forbid card, can subsequently swipe or otherwise present the management card or a second management card, for example, a cancel forbid card, to one card reader in the group. Responsive thereto, the associated access controller can update the associated database to indicate that access via a door associated with the one card reader is no longer forbidden. Responsive to the administrator swiping or otherwise presenting the management card or the second management card to the one card reader in the group, the associated access controller can also update the associated database to indicate that access via doors associated with all other card readers in the group is also no longer forbidden. Then, when a user presents any normal access card to either the one card reader or any of the other card readers in the group, access will be granted in accordance with the normal rules of the access control system.

FIG. 1 is a flow diagram of a method 100 in accordance with disclosed embodiments. As seen in FIG. 1, the method 100 can include dividing a plurality of card readers into one or more groups as in 110 and configuring one or more management cards for controlling access to regions secured by doors associated with the card readers as in 120. Then, the method 100 can include reading a first management card presented to a first card reader of a first group as in 130, identifying all card readers in the first group of which the first card reader is a part as in 140, and updating a database to indicate forbidden access via doors associated with each of the card readers in the first group as in 150. The method 100 can also include re-reading the first management card or reading a second management card presented to a card reader in the first group as in 160, identifying all card readers in the first group as in 170, and updating a database to indicate that access is no longer forbidden via doors associated with each of the card readers in the first group as in 180.

Figure 2:
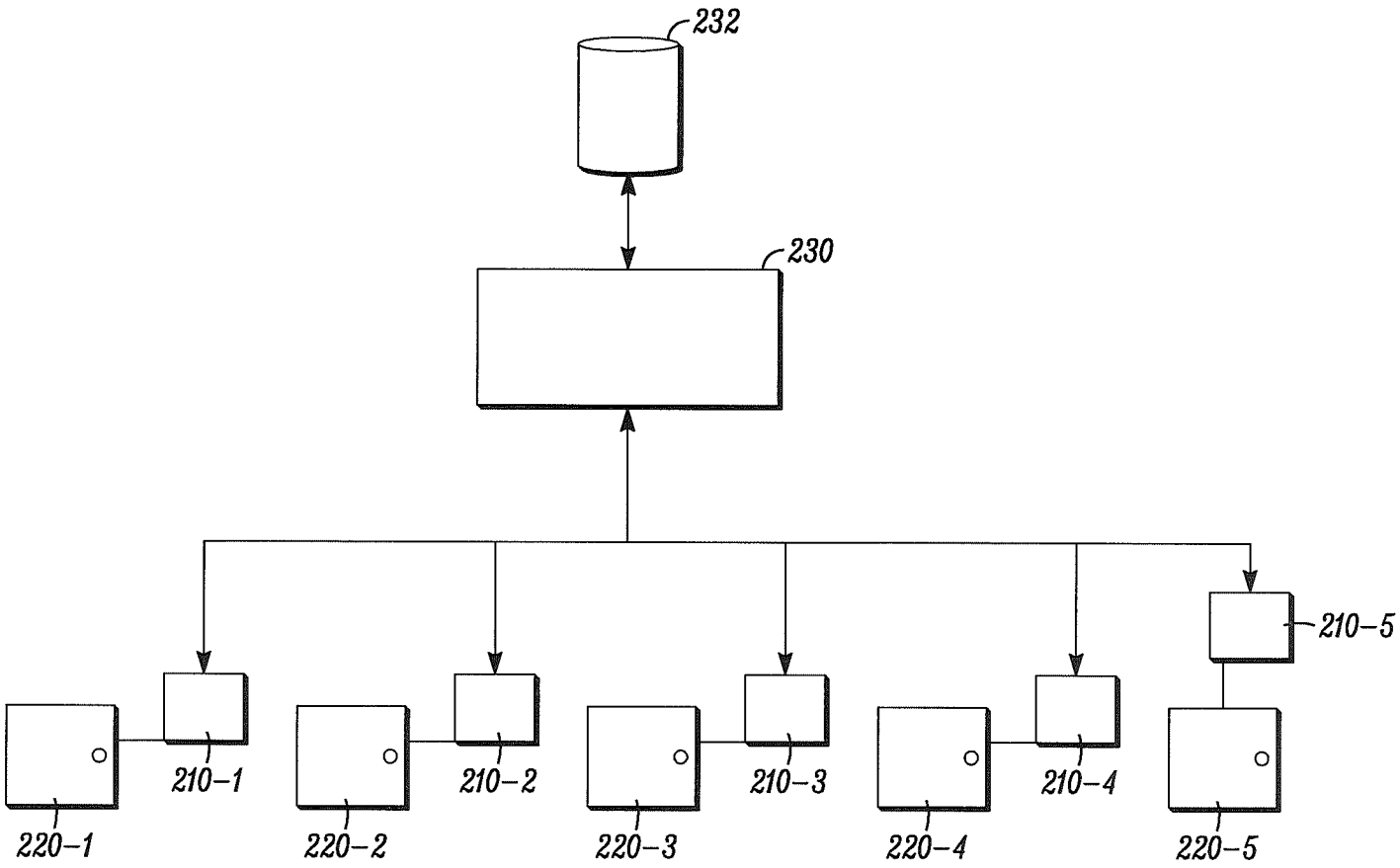
FIG. 2 is a block diagram of a system in accordance with disclosed embodiments.

FIG. 2 is a block diagram of a system 200 in accordance with disclosed embodiments. As seen in FIG. 2, the system 200 can include a plurality of card readers 210-1, 210-2, 210-3, 210-4, and 210-5 associated with respective doors 220-1, 220-2, 220-3, 220-4, and 220-5. Each of the card readers 210-1, 210-2, 210-3, 210-4, and 210-5 can be in communication with an associated access controller 230 as would be known in the art, and the access controller 230 can include or be associated with a database device 232.

It is to be understood that each of the card readers 210-1, 210-2, 210-3, 210-4, and 210-5 and the access controller 230 can include control circuitry, one or more programmable processors, and executable control software as would be understood by those of ordinary skill in the art. The executable control software can be stored on a transitory or non-transitory computer readable medium, including, but not limited to local computer memory, RAM, optical storage media, magnetic storage media, flash memory, and the like. In some embodiments, the control circuitry, the programmable processor, and the control software of each of the card readers 210-1, 210-2, 210-3, 210-4, and 210-5 and the access controller 230 can execute and control some of the methods describe above and herein.

In normal operation, a user can present a normal access card to any of the card readers 210-1, 210-2, 210-3, 210-4, and 210-5, and, responsive thereto, the access controller 230 can make an access determination according the access privileges of the access card stored in the database device 232. In some embodiments, during such normal operation, a user interface device of each card reader 210-1, 210-2, 210-3, 210-4, and 210-5 can be activated to show the normal status of the respective reader.

However, in accordance with disclosed embodiments, each of the card readers 210-1, 210-2, 210-3, 210-4, and 210-5 can be divided into groups. For example, the card readers 210-1 and 210-2 can be placed in Group 1, the card readers 210-3 and 210-4 can be placed in Group 2, and the card reader 210-5 can be placed in Group 3. Furthermore, first and second administrator management cards can be configured for controlling access to regions secured by the doors 220-1, 220-2, 220-3, 220-4, and 220-5. For example, the first administrator management card, a forbid card, can be configured for forbidding access to regions secured by the doors 220-1, 220-2, 220-3, 220-4, and 220-5, and the second administrator management card, a cancel forbid card, can be configured for canceling any forbidden access to regions secured by the doors 220-1, 220-2, 220-3, 220-4, and 220-5.

An administrator can present the first management card to the card reader 210-1. Responsive thereto, the access controller 230 can update the database device 232 to indicate that access via the door 220-1 associated with the card reader 210-1 is forbidden and also that access via the door 220-2 associated with the card reader 210-2, which is in the same Group 1 as the card reader 210-1 to which the management card was presented, is also forbidden. In some embodiments, the user interface device of the card readers 210-1 and 210-2 can be activated to show the forbidden status of the respective reader.

Subsequently, when a user presents a normal access card to either of the card readers 210-1 or 210-2, the access controller 230 can make a determination that access is forbidden and prevent the associated door 220-1 or 220-2 from opening. However, access via the doors 220-3, 220-4, and 220-5 associated with the card readers 210-3, 210-4, and 210-5 can be unaffected, and, as in normal operation, responsive to presenting a normal access card to any of the card readers 210-3, 210-4, and 210-5, the access controller 230 can make an access determination according the access privileges of the presented access card stored in the database device 232.

The administrator can present the second management card to the card reader 210-1 or present the first management card to the card reader 210-1 again. Responsive thereto, the access controller 230 can update the database device 232 to indicate that access via the door 220-1 associated with the card reader 210-1 is no longer forbidden and also that access via the other door 220-2 associated with the card reader 210-2, which is in the same Group 1 as the card reader 210-1 to which the second management card was presented or to which the first management card is re-presented, is also no longer forbidden. Additionally or alternatively, the administrator can present the second management card to the card reader 210-2 or present the first management card to the card reader 210-2. Responsive thereto, the access controller 230 can update the database device 232 to indicate that access via the door 220-2 associated with the card reader 210-2 is no longer forbidden and also that access via the other door 220-1 associated with the card reader 210-1, which is in the same Group 1 as the card reader 210-2 to which the second management card was presented or to which the first management card is presented, is also no longer forbidden. In some embodiments, the user interface device of the card readers 210-1 and 210-2 can be activated to show the normal status of the respective reader.

Subsequently, when a user presents a normal access card to any of the card readers 210-1, 210-2, 210-3, 210-4, and 210-5, the access controller 230 can make an access determination according the access privileges of the user stored in the database device 232.

Advantageously, the systems and methods disclosed herein can allow an administrator user in a monitored region to cause access by all users to be forbidden to selected areas via selected doors associated with selected card readers. That is, the administrator need not have manual access to the access controller or an associated host system to affect such forbidden access. Furthermore, the systems and methods disclosed herein can allow an administrator user to cause access to be forbidden via selected doors associated with a plurality of selected card readers in a group by taking action at only one card reader in the group.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

reading a first management card at a first card reader;

identifying a first group associated with the first card reader;

identifying a plurality of card readers in the first group;

updating a database device to indicate forbidden access via the first card reader or any card reader in the plurality of card readers;

after updating the database device to indicate the forbidden access via the first card reader or any card reader in the plurality of card readers, reading an access card at the first card reader or any card reader in the plurality of card readers; and responsive to reading the access card at the first card reader or any card reader in the plurality of card readers, determining the forbidden access regardless of access privileges associated with the access card in the database device.

2. The method of claim 1 further comprising activating a user interface device of each of the first card reader and each of the plurality of card readers indicative of the forbidden access.

3. The method of claim 1 further comprising:

prior to updating the database device to indicate the forbidden access via the first card reader or any card reader in the plurality of card readers, reading the access card at the first card reader or any card reader in the plurality of card readers; and responsive to reading the access card at the first card reader or any card reader in the plurality of card readers, determining the access privileges associated with the access card in the database device.

4. The method of claim 1 further comprising:

reading the access card at a card reader in a second plurality of card readers; and responsive to reading the access card at the card reader in the second plurality of card readers, determining the access privileges associated with the access card in the database device.

5. The method of claim 1 further comprising, responsive to determining the forbidden access, activating a user interface device of the first card reader or one of the plurality of card readers at which the access card was read, the user interface device being indicative of the forbidden access.

6. The method of claim 1 further comprising:

re-reading the first management card at the first card reader or any card reader in the plurality of card readers;

identifying the first group;

identifying the plurality of card readers in the first group; and updating the database device to remove any indication of the forbidden access via the first card reader or any card reader in the plurality of card readers.

7. The method of claim 6 further comprising:

after updating the database device to remove any indication of the forbidden access via the first card reader or any card reader in the plurality of card readers, reading the access card at the first card reader or any card reader in the plurality of card readers; and responsive to reading the access card at the first card reader or any card reader in the plurality of card readers, determining the access privileges associated with the access card in the database device.

8. The method of claim 1 further comprising:

reading a second management card at the first card reader or any card reader in the plurality of card readers;

identifying the first group;

identifying the plurality of card readers in the first group; and updating the database device to remove any indication of the forbidden access via the first card reader or any card reader in the plurality of card readers.

9. The method of claim 8 further comprising:

after updating the database device to remove any indication of the forbidden access via the first card reader or any card reader in the plurality of card readers, reading the access card at the first card reader or any card reader in the plurality of card readers; and responsive to reading the access card at the first card reader or any card reader in the plurality of card readers, determining the access privileges associated with the access card in the database device.

10. A system comprising:

a first card reader;

a database device;

one or more programmable processors; and executable control software stored on a non-transitory computer readable medium, wherein the first card reader reads a first management card, wherein the programmable processor and the executable control software identify a first group of which the first card reader is a part, wherein the programmable processor and the executable control software identify a plurality of card readers in the first group, wherein the programmable processor and the executable control software update the database device to indicate forbidden access via the first card reader or any card reader in the plurality of card readers, and wherein, after updating the database device to indicate the forbidden access via the first card reader or any card reader in the plurality of card readers, when the first card reader or any card reader in the plurality of card readers reads an access card, the programmable processor and the executable control software determine the forbidden access regardless of access privileges associated with the access card in the database device.

11. The system of claim 10 wherein the programmable processor and the executable control software activate a user interface device of each of the first card reader and each of the card readers in the plurality of card readers indicative of the forbidden access.

12. The system of claim 10, wherein, prior to updating the database device to indicate the forbidden access via the first card reader or any card reader in the plurality of card readers, when the first card reader or any card reader in the plurality of card readers reads the access card, the programmable processor and the executable control software determine the access privileges associated with the access card in the database device.

13. The system of claim 10, wherein, when a card reader in a second plurality of card readers reads the access card, the programmable processor and the executable control software determine the access privileges associated with the access card in the database device.

14. The system of claim 10 wherein, responsive to determining the forbidden access, the programmable processor and the executable control software activate a user interface device of the first card reader or one of the plurality of card readers at which the access card was read, the user interface device being indicative of the forbidden access.

15. The system of claim 10, wherein the first card reader or any card reader in the plurality of card readers re-reads the first management card, wherein the programmable processor and the executable control software identify the first group and identify the plurality of card readers in the first group, and wherein the programmable processor and the executable control software update the database device to remove any indication of the forbidden access via the first card reader or any card reader in the plurality of card readers.

16. The system of claim 15, wherein, after updating the database device to remove any indication of the forbidden access via the first card reader or any card reader in the plurality of card readers, the first card reader or any card reader in the plurality of card readers reads the access card, and responsive thereto, the programmable processor and the executable control software determine the access privileges associated with the access card in the database device.

17. The system of claim 10, wherein the first card reader or any card reader in the plurality of card readers reads a second management card, wherein the programmable processor and the executable control software identify the first group and identify the plurality of card readers in the first group, and wherein the programmable processor and the executable control software update the database device to remove any indication of the forbidden access via the first card reader or any card reader in the plurality of card readers.

18. The system of claim 17, wherein, after updating the database device to remove any indication of the forbidden access via the first card reader or any card reader in the plurality of card readers, the first card reader or any card reader in the plurality of card readers reads the access card, and responsive thereto, the programmable processor and the executable control software determine the access privileges associated with the access card in the database device.

* * * * *